United States Patent [19]

McGahey et al.

[11] 4,260,000

[45] Apr. 7, 1981

[54] FUEL DISPENSING SYSTEM WITH CONTROLLED VAPOR WITHDRAWAL

[75] Inventors: Dean C. McGahey, Fishkill; Eugene W. Vest, Wappingers Falls, both of N.Y.

[73] Assignee: Texaco Inc., White Plains, N.Y.

[21] Appl. No.: 45,702

[22] Filed: Jun. 4, 1979

[51] Int. Cl.[3] ..... B65B 3/18; B65B 31/06

[52] U.S. Cl. ..... 141/59; 141/286; 141/290

[58] Field of Search ..... 178/46; 141/1, 4, 52, 141/59, 285, 290, 392, 286

[56] References Cited

U.S. PATENT DOCUMENTS

| | | | |
|---|---|---|---|
| 3,913,633 | 10/1975 | Hiller | 141/59 |
| 3,981,334 | 9/1976 | Deters | 141/59 |
| 4,051,877 | 10/1977 | Fletcher | 141/4 |

*Primary Examiner*—Frederick R. Schmidt

*Attorney, Agent, or Firm*—Carl G. Ries; Robert A. Kulason; Robert B. Burns

[57] ABSTRACT

A system for concurrently transferring a volatile liquid fuel from a source thereof into a fuel tank, while receiving vapors which are displaced from the tank during the inflow of the liquid fuel. Included in the system is a vacuum assist arrangement capable of imposing a vacuum condition on the vapor return line to avoid passage of vapors to the atmosphere. The liquid phase of the system includes a liquid flow regulator adapted to establish a desirable flow rate. Further, a vapor restrictor interposed in the vapor section of the system includes means to both throttle and regulate the vapor flow whereby to establish a favorable vapor:liquid ratio during normal operation.

7 Claims, 2 Drawing Figures

FUEL DISPENSING SYSTEM WITH CONTROLLED VAPOR WITHDRAWAL

BACKGROUND OF THE INVENTION

During the transfer of a volatile liquid, such as gasoline from a storage facility, there may be an unsealed connection between the disconnectable nozzle and the tank being filled. As the transfer operation progresses, residual gases, as well as air contained within the tank, are sometimes displaced into the atmosphere.

Many municipalities and governmental agencies have proposed or adopted regulations intended to reduce or at least to control these emissions. One method toward complying with mandated regulations is the provision of a substantially, or completely closed system between the fuel source or storage facility and the tank or tanks being filled.

Such a closed system, as found for example at a service station, normally includes individual conduits which carry the vaporizable fuel. The remote end of each conduit is provided with a manually operated dispensing nozzle. The respective nozzles are adapted to be removably positioned within the filler pipe of a receiving tank. Further, the respective nozzles include means to form a partial and preferably a sealed engagement between the nozzle spout and the tank filler tube.

Also, in some instances the fuel carrying system is not fully closed, but rather is controllably vented to the atmosphere. With such an arrangement, as liquid is pumped from the source, either of two eventualities could occur. If fuel leaving the storage tank or source is not immediately replaced by vapor from the tank being filled, air will be drawn into the system. On the other hand, when excessive vapors are withdrawn from the tank being filled, vapors will have to be vented to avoid a pressure build-up.

Several embodiments of sealing arrangements have been found to be advantageous for providing the necessary partial or substantially vapor tight, yet disconnectable engagement with a receiving tank spout. One method for providing the desired engagement is to attach a cylindrical, flexible walled member such as a rubber boot or the like to each fuel dispensing nozzle.

The boot, when properly positioned, will substantially surround the nozzle spout while the latter is registered in place. By use of such an arrangement, when the nozzle is registered within a filler pipe of the receiving tank the walls of the flexible boot will be deflected and/or distorted. The boot will thereby define an annular vapor tight or substantially vapor tight passage.

This type of arrangement is generally found to be highly effective. Thus, when a fuel flow is introduced from a nozzle into a particular receiving tank, a slight pressure is produced within the tank to displace a mixture of air and fuel vapors. The displaced vapors will be urged through the annulus defined by the nozzle spout and the flexible member. The vapors are then conducted by way of the dispensing nozzle through a separate conduit to the fuel source. An alternate holding means for retaining the vapors can be provided rather than in the fuel storage tank.

The effectiveness of this system depends to a large degree on the compatability of the vehicle fuel tank with the nozzle. However, some care must be exercised by an operator to assure a satisfactory engaging relationship at the mating surfaces. If for any reason the contact edges of the nozzle boot do not engage the filler pipe, an imperfect seal arrangement is achieved and vapor leakage can occur.

In conjunction with the most efficient use of closed fuel systems, vacuum assist means have been devised which cause the vapor collection system to operate under a slight vacuum. Operationally, the vacuum system will function to establish a reduced pressure at the nozzle-tank filler pipe juncture, whereby to collect displaced vapor by aspiration.

With a vacuum assist arrangement incorporated into the fuel system a varying degree of vapor to liquid ratio, hereafter referred to as V/L, will be realized depending on the type of nozzle used. For example, with a relatively tight sealing nozzle at the fuel tank, a typical range of V/L ratios can extend from about 0.7 to 1.5. With a non-sealing nozzle, however, the maximum V/L will be somewhat less.

In any event, maintenance of a favorable V/L ratio will avoid ingesting excessive amounts of air which would tend to absorb hydrocarbons in the underground storage tank. The latter condition would result of course in emissions from the tank vent.

A typical range of V/L values with a non-sealing nozzle could extend from about 0.7 to 1.1. It is appreciated that these ranges are expressed as typical values rather than absolute values. In actual practice they could be greater or less depending on the adjustment and control of the dispensing system parameters.

It is therefore an object of the present invention to provide a simple fuel dispensing system which will minimize the quantity of hydrocarbon vapors which are passed to the atmosphere. A further object is to provide a vacuum assist arrangement within the fuel system which will cause the system to function at its maximum efficiency. A still further object is to provide a fuel dispensing system which concurrently regulates the inflow of liquid fuel, to the outflow of vapor, whereby to establish a favorable vapor:liquid ratio.

Toward achieving these objectives the present system overcomes or at least minimizes the potentially detrimental effects of a leak path at the nozzle-tank filler pipe juncture. There is thus provided means to regulate the liquid fuel flow which is discharged from the dispenser such that said flow is maintained within a predetermined range and not in excess of a maximum value. This is achieved through the facility of a suitable liquid flow regulator means which is connected in conjunction with the storage fuel tank, and more preferably with the dispensing mechanism.

Further, vapor throttling means such as a constriction or an orifice is formed in the vapor line. This constriction is at a location where it will affect the vapor flow discharged through the receiving tank; said vapor flow is also affected by the vacuum established through the vacuum assist arrangement.

Figure 1:
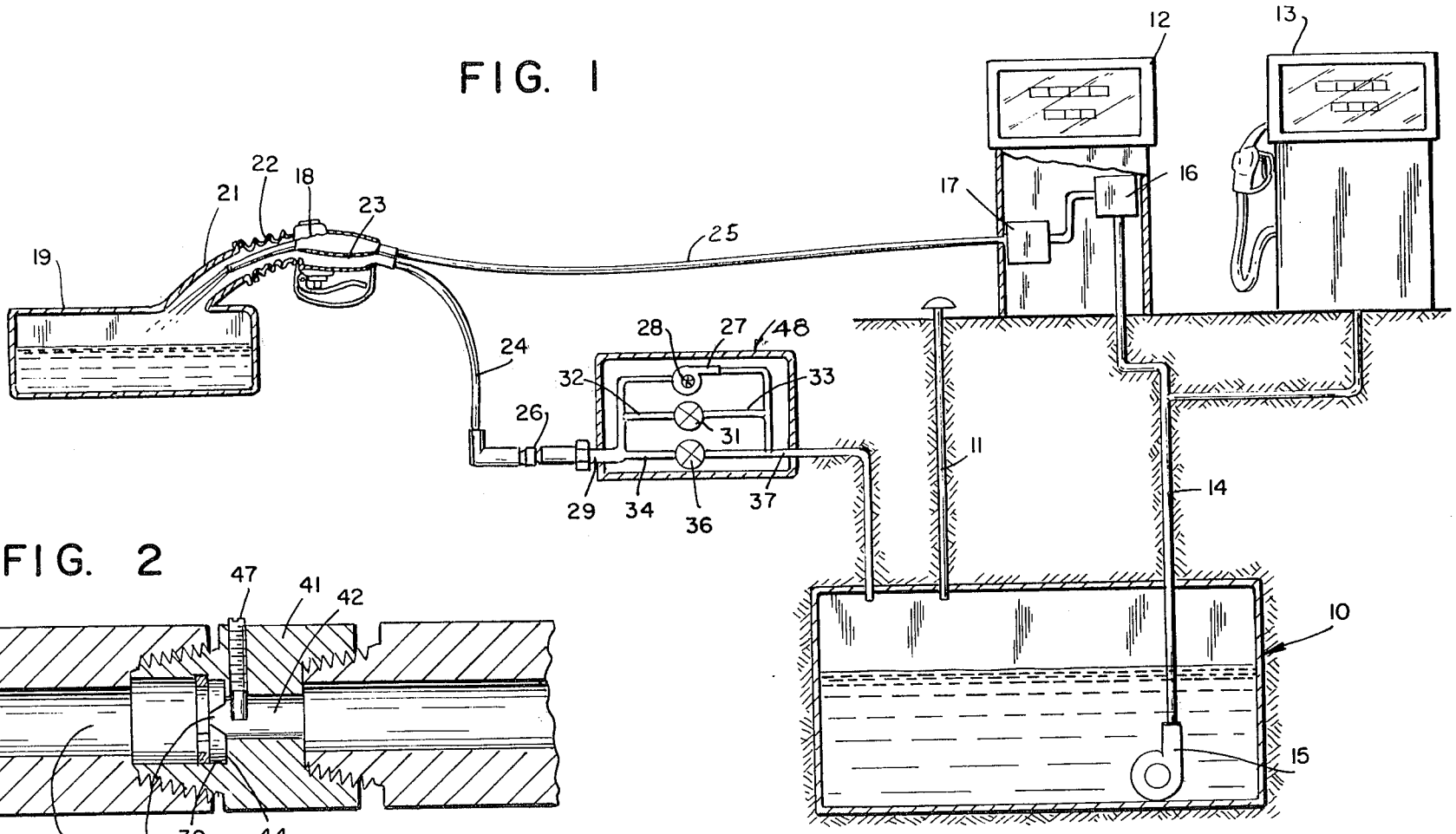
FIG. 1 represents an overall schematic diagram of a substantially closed fuel dispensing system.

Referring to the drawings, the system as generally disclosed illustrates an installation representative of a typical refueling station. This is preferably a service or refueling station for vehicles, boats, planes, etc. into which a vacuum assist arrangement is incorporated.

The installation as shown includes primarily a reservoir or storage tank 10 which is normally buried beneath ground level. A venting means 11 extends from the upper end of the storage tank. This feature permits passage of vapors into the atmosphere only at such time as the pressure within tank 10 exceeds atmospheric pressure.

In accordance with the general arrangement of most automotive refueling stations, the installation is provided with at least one, and preferably a series of terminal dispensers 12 and 13. Frequently the dispensers will dispense a different grade of fuel. In the arrangement shown, however, all of the dispensers will be assumed to handle the same fuel.

Normally, a vehicle can temporarily park adjacent to one of the said dispensers to receive a transfer of fuel therefrom. Each terminal dispenser is supplied from a principal liquid fuel carrying manifold 14. Said manifold is in turn communicated with the reservoir or storage tank 10 by way of pump 15. Operationally, although not shown in detail, a metering means 16 at each terminal dispenser is actuated to measure the fuel flow which passes to a vehicle.

Subsequent to leaving the fuel registering device, the fuel is passed through a self-adjusting regulator 17 which is capable of altering its setting to achieve a desired rate of flow therethrough below a maximum level.

Each terminal dispenser, 12 for example, further includes a dispensing nozzle 18 which is connected to fuel carrying hose 25. Said member is manually operable to control the fuel flow entering a vehicle's receiving tank 19. To function properly in the present system, a dispensing nozzle 18 is adapted to be removably registered within the filler pipe 21 of a receiving tank 19.

Nozzle 18 is provided with means for establishing the necessary disconnectable engagement, and preferably a sealed tight relationship with tank 19. Engagement is normally initiated by inserting nozzle 18 into filler pipe 21. This insertion is for a sufficient distance to form the desired substantially vapor tight seal between the filler pipe 21, lip 20, and deformable boot member 22 depending from the nozzle spout.

Sealable nozzles of this type are well known in the art. Further, a number of embodiments have been widely used to establish the desired closed or substantially vapor tight relationship with an automotive receiving tank.

Functionally, although not instantly shown, each terminal station such as 12, usually includes means by which fuel flow can be manually initiated at the dispenser. Switching means is also provided at each terminal dispenser, and is manually actuated by an operator upon removal of the nozzle from its resting or shut off position. This latter feature is not shown specifically since it also is a concept well known in the art and long used in service stations of the type contemplated.

To remove vapors, including both fuel and air from a receiving tank 19 during a fuel transfer operation, nozzle 18 is provided with internal valved passages for carrying liquid fuel. The nozzle is further provided with discrete passages 23 for conducting vapors which are displaced from receiving tank 19.

Said vapors, when withdrawn, are thereafter introduced to a vapor return line 24 by way of a constricted portion 26 in the line. They are thence led back to the storage tank 10 by way of the vacuum assist arrangement 48.

Vacuum source or assist arrangement 48, which is shown schematically, includes in one embodiment a motor driven vapor inductor such as a fan, impeller 27 or the like. Said inductor includes an inlet 28 which is communicated with the system's vapor carrying manifold 29. The inductor discharge port is communicated with reservoir 10 to deposit a flow of withdrawn vapors into the latter.

Returning vapor as shown, is deposited into reservoir 10 from which liquid fuel was initially drawn. It is understood, however, that said vapors can likewise be deposited into a suitable alternate receptacle or reservoir. Such alternative will depend on the capability of the facility for receiving and storing vapors.

Vapor inductor 27 further includes a valved bypass disposed to communicate the inductor inlet port with the outlet port. Said valved bypass includes valve means 31 which is operable to regulate the flow of vapor through inductor 27 as well as the bypass.

Valve 31 is communicated with inductor inlet 28 by way of a line 32, and with the inductor outlet by way of a second line 33. Valve 31 is normally preset to afford a desired rate of vapor recirculation through the inductor. Said vapor flow is preferably far in excess of the amount of vapor which is to be withdrawn collectively from the entire fuel dispensing unit. Recirculated vapor flow through inductor 27 can thus be many times the maximum flow which is expected to be withdrawn from the receiving tank or tanks 19.

As a safety measure the vapor inductor 27 can be provided with flame arresting means disposed upstream and/or downstream thereof. This will prevent propagation of any flame which might be initiated as result of an inadvertent ignition of vapor which passed through the inductor.

Subsequent to leaving nozzle 18, fuel vapors under certain temperatures could condense within the vapor conduit 29. Said conduit is therefore preferably not only buried, but is placed at a predetermined slope to promote drainage of condensate back to storage tank 10.

To avoid the entry of condensate into the vapor inductor circuit of the vacuum source 48, the underground return line 29 is provided with a liquid bypass which allows liquid to flow toward storage tank 10, but inhibits any tendency for vapor to flow in the reverse direction. Said bypass includes a first line 34 which communicates with the lowest end of the vapor conduit 29. Said line 34 thus passes condensate into a check valve 36, which in turn communicates with the storage tank 10 by way of return line 37.

The vapor flow control means between removable nozzle 18 and the vacuum assist or vacuum source 48, comprises an elongated flexible conduit such as a rubber hose or the like into which vapor passage 24 is formed. To provide the needed regulation of vapor flow, constriction 26 is provided. The constriction can assume any one of a number of embodiments which are capable of narrowing the normal flow passage between nozzle 18 and the vacuum assist or vacuum source unit 48.

Figure 2:
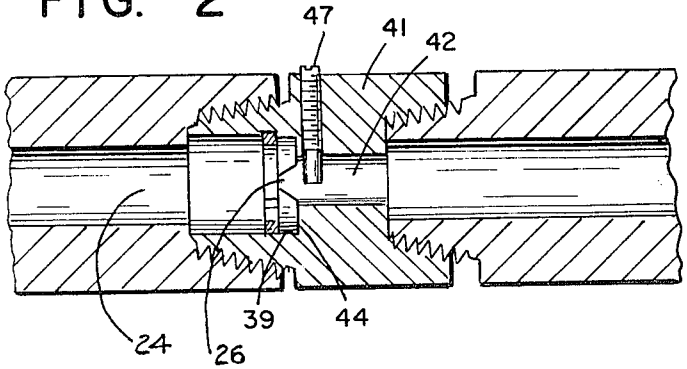
FIG. 2 is a cross-sectional view of a portion of the vapor carrying hose shown in FIG. 1.

Referring to FIG. 2 in the present arrangement, constriction 26 is comprised of a sharp edged orifice plate 39 through which the vapor normally flows. The vapor passage includes a threaded end adapter 41 having a central passage 42 therethrough. Said adapter is threadably received in the back face of nozzle 18.

Adapter 41 includes central passage 42 which opens into a cavity 43 at the forward end, into which cavity orifice plate 39 is received. The latter can be held in place by any suitable means such as being threaded in place, or locked therein as to be substantially fixed against a shoulder 44.

The downstream end of adapter 41 includes passage 42 into which vapor is permitted to expand as it leaves the opening of orifice plate 39. Said passage 42 is provided with a further deterrent to vapor flow in the form of an adjustable member 47 adapted to protrude from the adapter wall 41, into the vapor flow stream.

In the present instance said flow adjusting member 47 is embodied in a screw which is threadably positioned within a wall of the adapter, normal to passage 42. Seal means can be provided in conjunction with screw 47 although such is not essential. Screw 47, however, is nonetheless of sufficient length to extend downward toward the center of the flow passage 42, whereby to be positioned in the direct path of the vapor stream as the latter leaves the orifice.

By so positioning adjusting screw 47, the nature of vapor flow through the orifice can be regulated to a point where it will effectively regulate the volumetric flow of vapor through the orifice.

To illustrate the operation of the fuel dispensing system herein, assume that it is determined to operate at an ideal V/L ratio that ranges between 0.8 and 1.0. A further assumption is made that the minimum dispensing fuel rate of the nozzle is to be 5 gallons per minute, and the vacuum generated by inductor 27 or the vacuum assist system 48, is adjusted to cause 5 gallons per minute of vapor flow through nozzle 18 when the latter is in operation.

The V/L ratio under these conditions would be 1.0 (5 gallons of vapor returned for every 5 gallons of liquid dispensed). Since the vapor flow rate is essentially constant, the maximum flow rate of liquid at the lower V/L of 0.8 can be easily determined by dividing 5 gallons per minute of vapor by 0.8.

The result is 6.25 gallons per minute of liquid. Therefore, if liquid flow regulator 17 is adjusted to 6.25 gallons per minute maximum, the V/L during the period of operation would range between the desired values of 0.8 and 1.0.

The V/L ratio could of course be adjusted to achieve other values by similar adjustments at flow regulator 17. Another approach to adjusting the entire system is to set the V/L ratio at a higher fuel dispensing rate.

For example, assume that liquid flow regulator 17 is adjusted to limit the maximum dispensing rate to 8 gallons per minute. Further, the vacuum in the vapor line 24 is adjusted to give a vapor flow rate of 8 gallons per minute as well. Then the V/L ratio would be 1.0 at a dispensing rate of 8 gallons per minute.

With the positioning of the orifice plate 39 as shown in the vapor return line 24, a number of additional benefits are realized. For example, when the orifice plate is located at or adjacent to nozzle 18, minimal quantities of fuel will enter the vapor return hose in the event of fuel splashback from the filler pipe 21. In this instance the orifice plate 39 acts as a baffle to impede passage of liquid into hose 24.

A further advantage inherent in the instant orifice is that it functions as an anti-recirculation device. For example, if the automatic nozzle flow shut-off fails to function in response to fuel rise in filler pipe 21, fuel will enter the vapor passage in nozzle 18, and thereafter flow into the vapor hose 24. However, the resistance represented by the orifice 39 will quickly cause the positive pressure trip mechanism in the nozzle to function thereby ending such undesired flow.

However, to function as a means to regulate vapor flow, the orifice can be so located in any part of the vapor system leading to a single nozzle.

Other modifications and variations of the invention as hereinbefore set forth can be made without departing from the spirit and scope thereof, and therefore, only such limitations should be imposed as are indicated in the appended claims.

We claim:

1. A dispensing system for a vaporizable liquid which is held in a storage tank 10, a dispenser including a pump 15 having its suction communicated with the storage tank 10 to receive a flow of liquid from the latter, and the pump 15 having a discharge communicated with a liquid flow regulator 17;

a vacuum source 48 including an inductor 27 means inlet 28 and outlet ports, and being operable to circulate a vaporous stream of said vaporizable liquid and to establish a vacuum condition at the inlet port 28 thereof, and having the inductor outlet port communicated with said storage tank 10, a nozzle 18 adapted to removably engage a tank 19 positioned to receive a flow of the liquid, said nozzle 18 including a vapor passage 23 to receive vapors which are displaceable from said tank 19 by incoming vaporizable liquid, first conduit means 25 communicating said nozzle 18 with said flow regulator 17 to receive a controlled fuel flow from the latter, second conduit means 24 communicating said nozzle vapor passage 23 with said vacuum source inductor inlet 28 whereby to establish a reduced pressure in the said second conduit means 24 while vapor is flowing therethrough, and a constricted section 26 in said second conduit means 24 positioned to throttle the flow of vapor flowing through the latter.

2. In an apparatus as defined in claim 1, wherein the constricted section is disposed immediately downstream of said nozzle.

3. In an apparatus as defined in claim 1, wherein said constricted section includes; an adjusting means operable to regulate the volume of vapor flowing therethrough.

4. In an apparatus as defined in claim 1, wherein said constricted section includes; a plate orifice disposed transversely of said second conduit means.

5. In an apparatus as defined in claim 4, including; a flow deflector member disposed immediately adjacent the downstream side of said plate orifice to deflect vapor flow emerging from the orifice opening.

6. In an apparatus as defined in claim 5, wherein said flow deflector member is adjustably positioned to adjust the vapor flow rate.

7. In an apparatus as defined in claim 5, wherein said flow deflector member includes an elongated member being threadably adapted to move transversely of the vapor flow passing through said plate orifice.

* * * * *